US007013858B2

(12) United States Patent
Claus et al.

(10) Patent No.: US 7,013,858 B2
(45) Date of Patent: Mar. 21, 2006

(54) METHOD FOR THE PRODUCTION OF A VALVE SEAT

(75) Inventors: Juergen Claus, Fellbach (DE); Reiner Heigl, Remseck (DE); Harald Pfeffinger, Tiefenbronn (DE)

(73) Assignee: DaimlerChrysler AG, Stuttgart (DE)

( * ) Notice: Subject to any disclaimer, the term of this patent is extended or adjusted under 35 U.S.C. 154(b) by 192 days.

(21) Appl. No.: 10/495,568

(22) PCT Filed: Oct. 18, 2002

(86) PCT No.: PCT/EP02/11682

§ 371 (c)(1),
(2), (4) Date: Nov. 1, 2004

(87) PCT Pub. No.: WO03/042508

PCT Pub. Date: May 22, 2003

(65) Prior Publication Data

US 2005/0034700 A1 Feb. 17, 2005

(30) Foreign Application Priority Data

Nov. 15, 2001 (DE) ..... 101 56 196

(51) Int. Cl.
*F02B 75/06* (2006.01)

(52) U.S. Cl. ..... 123/188.8; 29/888.44
(58) Field of Classification Search ..... 123/188.8; 29/888.4, 888.44
See application file for complete search history.

(56) References Cited

U.S. PATENT DOCUMENTS 4,765,955 A 8/1988 Yabuki et al.

FOREIGN PATENT DOCUMENTS

| | | | |
|---|---|---|---|
| DE | 2200003 | | 7/1973 |
| DE | 3517077 | C1 | 11/1986 |
| DE | 4443772 | A1 | 8/1995 |
| DE | 19639480 | A1 | 4/1998 |
| DE | 19912894 | A1 | 7/2000 |
| DE | 19912889 | A1 | 9/2000 |
| EP | 0092683 | B1 | 11/1983 |
| EP | 0228282 | B1 | 7/1987 |
| EP | 0759500 | A1 | 8/1995 |
| EP | 0939139 | A2 | 2/1999 |
| EP | 1120472 | A2 | 2/1999 |
| GB | 618607 | | 2/1949 |

*Primary Examiner*—Noah P. Kamen
(74) *Attorney, Agent, or Firm*—Crowell & Moring LLP

(57) ABSTRACT

This invention relates to a method for the production of a valve seat (5) for a cylinder head of an internal combustion engine. According to said method, an additional material is melted with the cylinder head by applying energy in the site in which the valve seat (5) is to be formed. An alloy or a mixture consisting of an aluminum-iron alloy and at least another component is used as additional material.

27 Claims, 3 Drawing Sheets

METHOD FOR THE PRODUCTION OF A VALVE SEAT

This application claims the priority of German Patent Document No. 101 56 196.2, filed 15 Nov. 2001, and PCT/EP02/11682, filed 18 Oct. 2002 the disclosure of which is expressly incorporated by reference herein, respectively.

BACKGROUND AND SUMMARY OF THE INVENTION

The invention relates to a process for producing a valve seat for a cylinder head of an internal combustion engine. Furthermore, the invention relates to a valve seat arrangement for a cylinder head of an internal combustion engine.

DE 199 12 889 A1 describes a process of the generic type for producing a valve seat. In this process, a filler material, namely an alloy or a mixture of an aluminum-silicon alloy and nickel, is fused to the base material of the cylinder head by a laser beam.

DE 35 17 077 C1 describes a process for cladding the valve seat surface of a gas exchange valve, in which cladding material preferably consisting of a nickel- or cobalt-base superalloy is introduced into an encircling recess at the valve disk.

A process for coating the surface of metallic workpieces with a filler material that is in powder or wire form is described by DE 199 12 894 A1.

A further process of this type is described in EP 00 92 683 B1. The base material of the cylinder head in this case substantially comprises aluminum, and either iron or nickel or an alloy containing one of these two metals as its main constituent is used as a filler material for forming the valve seat.

A drawback of such a process is that iron and nickel have a significantly higher melting point than the cylinder head, which consists of aluminum. This can mean that the cylinder head has already melted under the application of a laser beam when the filler material is just starting to melt. Moreover, the iron which was previously in liquid may solidify while the aluminum is still in the form of a melt. This leads to the formation of intermetallic phases in the boundary region between the iron material and the aluminum material, which can give rise to a very brittle microstructure. Therefore, it is difficult to achieve a homogeneous join between the valve seat which is to be created and the base material of the cylinder head; the different surface tensions of the materials also play a major role in this respect.

EP 02 28 282 B1 describes a cylinder head consisting of an aluminum alloy. The valve seats of this cylinder head are formed from a plated-on copper alloy layer.

However, if copper is used as a material for valve seats, in particular in the case of diesel engines, the sulfur which is contained in the diesel fuel can attack the copper, resulting in problems with regard to exhaust emissions and corrosion. Therefore, the use of copper for valve seats is only suitable for spark-ignition economically viable way.

DE 196 39 480 A1 describes a process for the internal coating of cylinder liners by means of filler materials in powder form which are alloyed on by laser radiation.

A process for the surface treatment of light metal components, in particular of light metal pistons of internal combustion engines, with a strength-enhancing and/or wear-resistant filler material is described by DE 22 00 003 A1.

It is an object of the present invention to provide alternative processes for producing valve seats for the cylinder head of an internal combustion engine.

According to an embodiment of the invention, this object is achieved by use of a filler material that is an alloy or mixture of an aluminum-iron alloy and at least one further constituent.

Given a suitable design of the cylinder head, an alloy of this type can be an alloy of the same type as the base material of the cylinder head, which often consists of an aluminum-silicon alloy. This allows for good metallurgical bonding without the formation of brittle intermetallic phases at the interface between the coating or filler material and the base material. Consequently, there is little tendency for cracks to form. The iron content in the alloy used for the filler material in accordance with the invention advantageously increases the hardness thereof.

In an alternative embodiment a filler material is used comprising an alloy or mixture of aluminum and titanium.

In such an embodiment, the advantages which have already been referred to above in connection with the use of an alloy of the same type as the base material, such as reduced likelihood of cracks forming, also apply. An intermetallic phase of titanium and aluminum is advantageously formed, bringing benefits with regard to the hardness, the resistance to wear and the thermal stability of this alloy.

In still another embodiment, a filler material is used comprising an alloy or mixture of an iron-carbon alloy and at least one further constituent.

This composition is in principle based on conventional materials of valve seat rings fitted as separate parts, but can likewise be applied by means of the melting process according to the invention and has a high hardness and very good wear properties.

In yet another embodiment filler material is used comprising an alloy or mixture of a nickel-chromium alloy and at least one further constituent.

An alloy of this type allows high resistances to temperature and wear to be achieved and, given a suitable selection of the further constituent, has very good tribological properties.

A common feature of all of the above embodiments is that the bonding of the valve seat to the cylinder head is durable and can therefore be used successfully in practice. Furthermore, the mixtures and alloys described contribute to a considerable increase in the process reliability.

In another embodiment, the invention comprises a cylinder head of an internal combustion engine.

According to an embodiment, the valve seat arrangement comprises annular regions which widen the valve seats and partially overlap one another. As a result the regions between the actual valve seats, known as the valve lands, also consist of the higher-quality material used for the valve seats. This has the advantage of considerably reducing the susceptibility of these valve lands and of the associated region of the respective combustion chamber of the cylinder head to cracking. As a result, higher thermal and mechanical loading of the cylinder head is possible in this region.

BRIEF DESCRIPTION OF THE DRAWINGS

Advantageous configurations and refinements of the invention will emerge from the subclaims and from the exemplary embodiments which are outlined below with reference to the drawing, in which:

FIG. 1 shows part of a cylinder head 1 of an internal combustion engine, the remainder of which is not shown. The cylinder head 1 has, in a manner which is conventional, an intake port 2, which in the present case could also be formed as an exhaust port. The intake port 2 is closed and opened by a gas exchange valve 3, which is referred to below simply as valve 3 for the sake of simplicity, so that a fuel/air mix can enter a combustion chamber 4 of the cylinder head 1 from the intake port 2.

Figure 1:
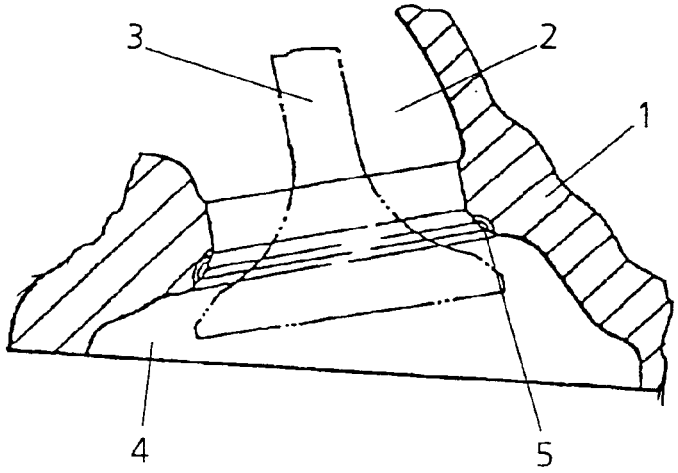
FIG. 1 shows a valve, arranged in a cylinder head of an internal combustion engine, with a valve seat.

The cylinder head 1 is provided with a valve seat 5, against which the valve 3 bears in its closed state, thereby disconnecting the intake port 2 from the combustion chamber 4.

FIGS. 2 to 6 illustrate various embodiments of the valve seat 5, while the process used to produce the corresponding valve seat 5 will be described further on in the description, with reference to FIGS. 7 and 8.

Figure 2:
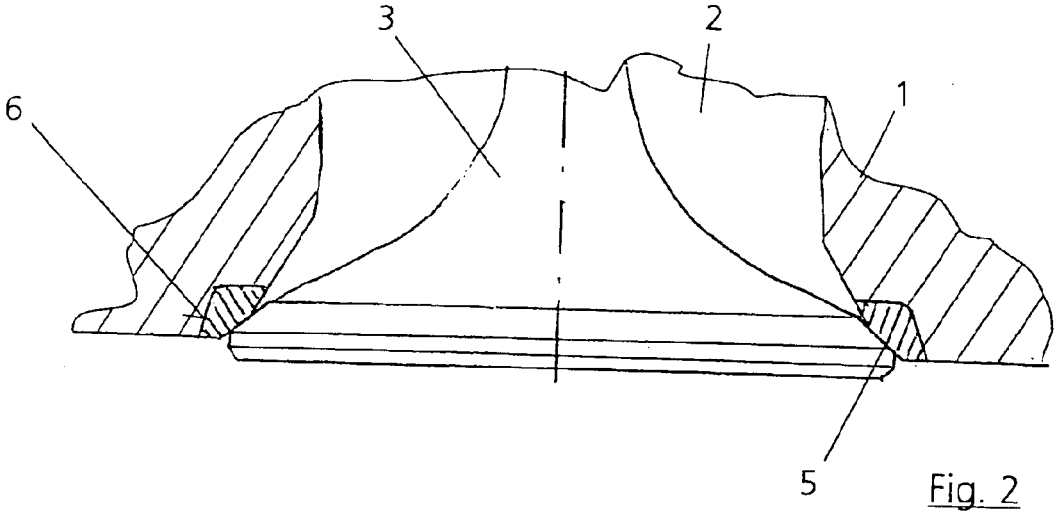
FIG. 2 shows an enlarged view of an alternative embodiment of the valve seat.

The valve seat 5 shown in FIG. 2 is accommodated in an encircling groove 6 of the cylinder head 1. The valve seat has a thickness of approx. d=1–6 mm, is provided with a radius r at the corner point which is located completely inside the cylinder head 1, and the angle $\alpha$ formed by the connecting surface of the valve seat 5 and the cylinder head 1 with respect to the longitudinal axis of the valve 3 is approx. $\alpha$=0°–45°. The structure described, in particular the thickness d which is indicated, results in a sufficient wearing reserve for any remachining, for example in the event of a repair being required.

Figure 3:
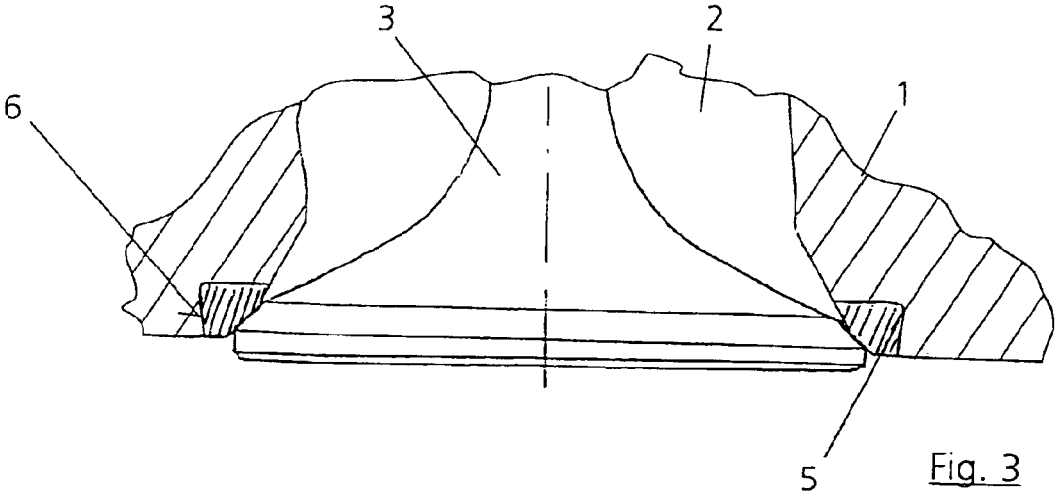
FIG. 3 shows an enlarged view of a further alternative embodiment of the valve seat.

FIG. 3 illustrates a further embodiment of the valve seat 5, which is similar to that shown in FIG. 2. However, the angle a with respect to the longitudinal axis of the valve 3 is negative. In other words the valve seat 5 has an undercut with an angle of approx. $\alpha$=2–15° with respect to the groove 6 in the cylinder head 1, causing the coating or valve seat 5 to be wedged such that it cannot drop out of the groove 6.

Figure 4:
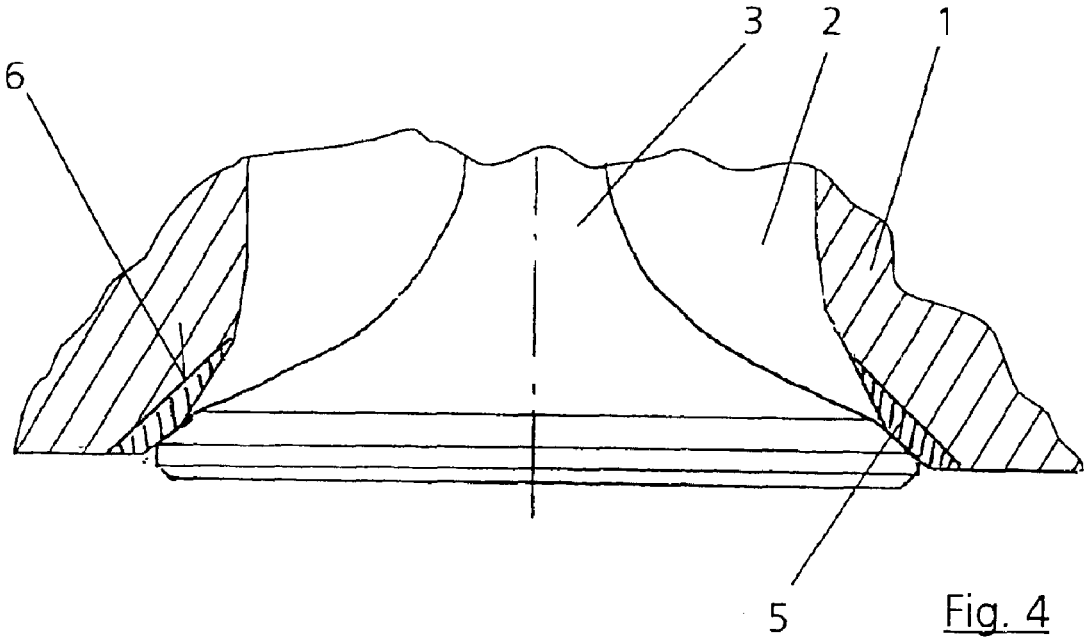
FIG. 4 shows an enlarged view of a further alternative embodiment of the valve seat.

The thickness d of the valve seat 5 shown in FIG. 4 is approx. d=0.5–5 mm. The angle a of the connecting surface between the valve seat 5 and the cylinder head 1, which in this case is designed to be straight, with respect to the longitudinal axis of the valve 3 is approx. $\alpha$=45°, although slight deviations are of course also possible.

In all the embodiments shown in FIGS. 2, 3 and 4, geometric space savings are possible compared to conventional seat ring geometries.

Figure 5:
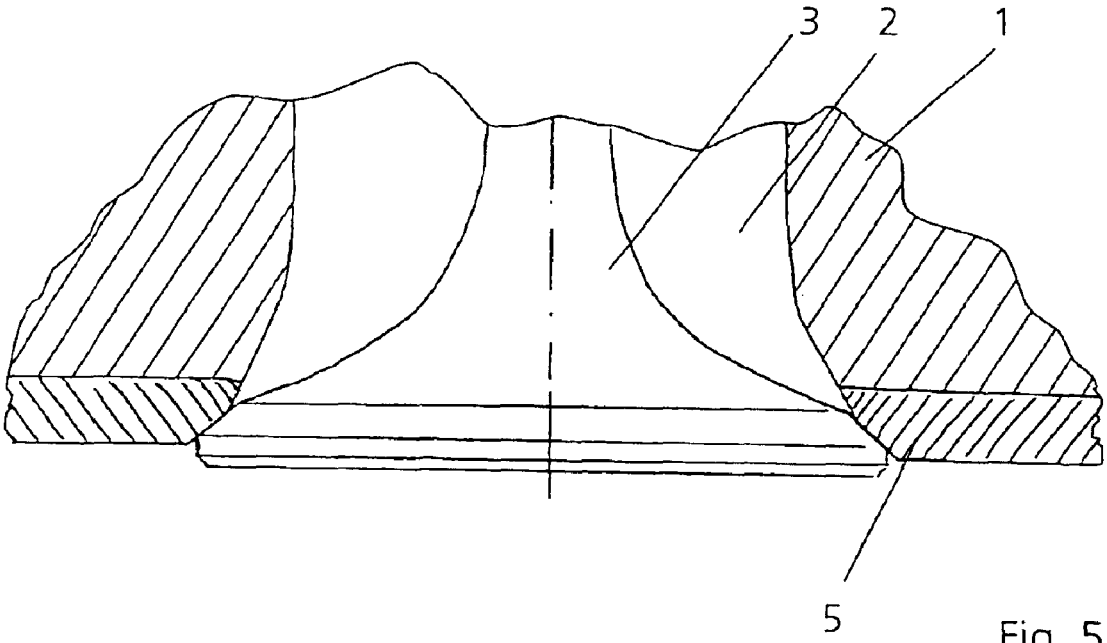
FIG. 5 shows an enlarged view of a further alternative embodiment of the valve seat.
Figure 6:
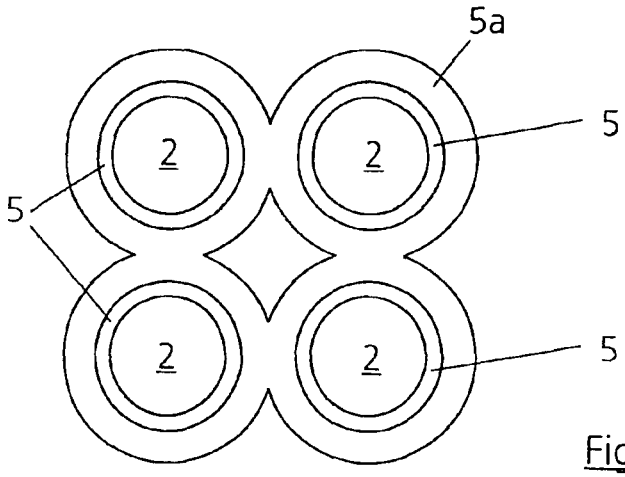
FIG. 6 shows an enlarged view of a further alternative embodiment of the valve seat.

A further embodiment of the valve seat 5 is shown in FIGS. 5 and 6; in these cases, the valve seat 5 takes up a much larger area than in the case of the embodiments described above. In other words, the valve seats 5 are widened by an annular region 5*a*. The individual regions 5*a* partially overlap one another, so that the regions between the actual valve seats 5, namely what are known as the valve lands, also consist of the higher-quality material for the valve seats 5. This considerably reduces the susceptibility of the valve lands and the associated region of the respective combustion chamber 4 of the cylinder head 1 to cracking, so that in this region a higher thermal and mechanical loading of the cylinder head 1 is possible. The thickness d of the valve seat 5 is d=1–10 mm.

Figure 7:
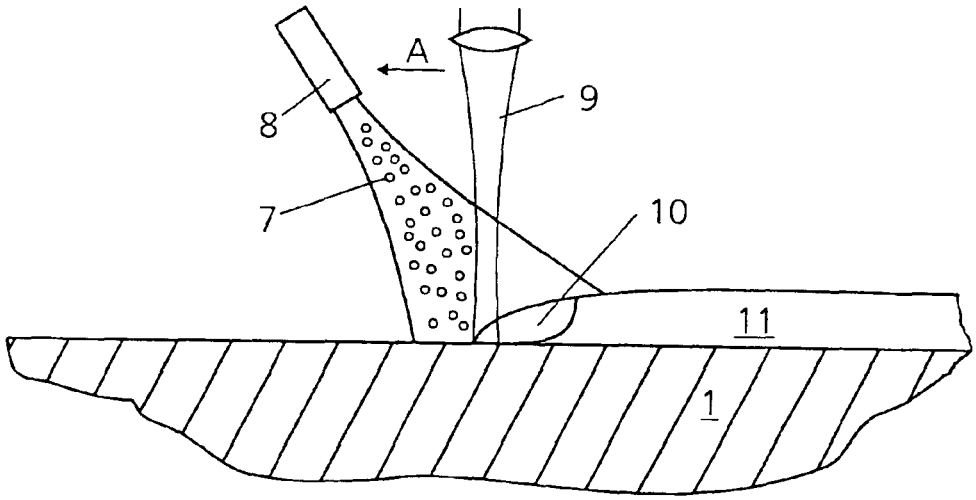
FIG. 7 shows the process according to the invention as a single-stage process.
Figure 8:
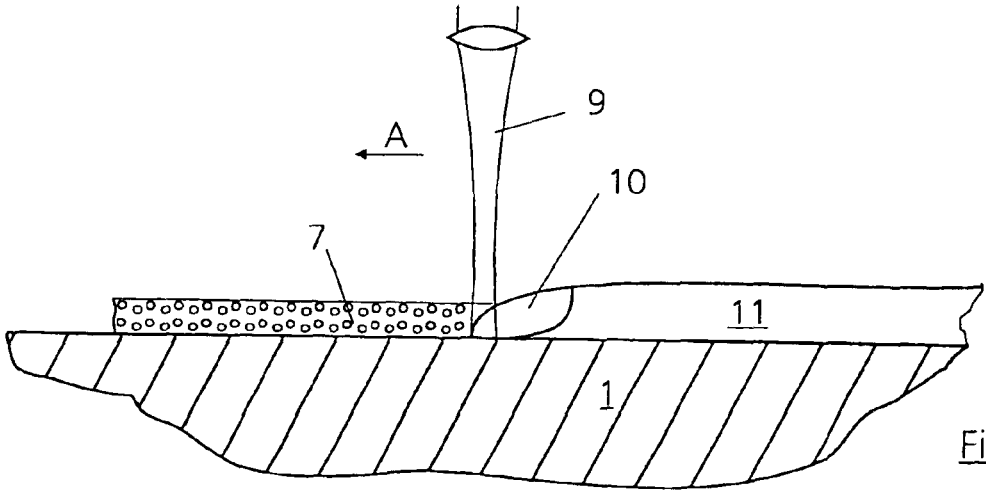
FIG. 8 shows the process according to the invention as a two-stage process.

FIG. 7 and FIG. 8 show two different processes for producing the valve seat 5. A filler material 7 in the form of a powder is applied to the base material of the cylinder head 1. The filler material can be a light metal alloy, such as for example an aluminum-silicon alloy. The constituents of the filler material 7 will be dealt with in more detail below. As an alternative to an aluminum-silicon alloy as the base material of the cylinder head 1, other light metal alloys can be used, and if appropriate also gray cast iron or other alloys.

To apply the filler material 7, a nozzle 8, which discharges the filler material 7 toward the cylinder head 1, is arranged in the region of the valve seat 5 which is to be formed. When the filler material 7 hits the cylinder head 1, in the embodiment shown in FIG. 7 it is simultaneously melted, together with the outer layer of the base material of the cylinder head 1, by a laser beam 9 in order to produce a melt 10 at the cylinder head 1. As an alternative to using the laser beam 9 as energy source, it is also possible to use an electron beam (not shown) in order to produce the melt 10 from the filler material 7 by introduction of energy.

To achieve a continuous process, the nozzle 8 and the laser beam 9 are constantly advanced in a circular motion. When the laser or electron beam 9 has been removed from the melt 10 in the direction of advance indicated by the arrow A, the melt solidifies to form a layer 11 which forms the valve seat 5.

FIG. 8 shows an alternative process for producing the valve seat 5, in which the filler material 7 is applied to the cylinder head 1 or introduced into the groove 6, in the form of a paste, a wire, a sintered body or powder preform. The filler material is then melted to form the melt 10 by means of the laser beam 9 or alternatively by means of an electron beam. The layer 11 which forms the valve seat 5 is formed from the melt 10 after the laser beam 9 has been removed in the direction indicated by arrow A. This process is referred to as a two-stage process.

If the filler material 7 has already been heated or partially or completely melted by the uptake of energy even before it strikes the surface of the cylinder head 1, it is possible to reduce the amount of energy introduced by the primary energy source, i.e. the laser beam 9 or the electron beam. As a result, the base material of the cylinder head 1 is only slightly melted, with the result that the occurrence of brittle phases and the formation of cracks in the interface between the cylinder head 1 and the valve seat 5 are reduced. This allows materials which are otherwise relatively unsuitable to be used as filler material 7. This procedure is particularly suitable for the two-stage process described above.

In a manner which is not illustrated, a magnetic field, which imparts contours to and/or intimately mixes the filler material 7 and/or the melt 10 formed from the filler material 7, may be provided in the region of the valve seat 5, leading to a more homogeneous distribution of the substances within the melt 10. Furthermore, it is in this way possible for any pores which may be present in the melt 10 to be eliminated through the expulsion of gases.

Various types of mixtures and alloys can be used for the filler material 7 both in the process shown in FIG. 7 and in the process shown in FIG. 8, and these mixtures and alloys are listed below:

The filler material 7 used may firstly be an alloy or mixture of an aluminum-iron alloy and at least one further constituent. The aluminum-iron alloy may contain 6–13% by weight of iron and 87–94% by weight of aluminum.

As further alloying constituent, the filler material 7 may contain 1–3% by weight of vanadium and/or 1–3% by weight of silicon.

Furthermore, it is conceivable for the filler material 7 to contain 30–55% by weight of nickel and then if appropriate 3–15% by weight of copper.

Alternatively, the filler material 7 may also contain 5–20% by weight of nickel and then if appropriate 35–45% by weight of copper.

The use of nickel and copper gives rise to nickel-aluminum and/or copper/aluminum phases, which increase the hardness of the valve seat 5.

A further constituent of the filler material 7 may be 0.2–1% by weight of magnesium and 0.2–2% by weight of boron, titanium and/or scandium. This leads to a finer formation of intermetallic phases and an improved microstructural homogeneity.

Moreover, if appropriate it is also conceivable for the filler material 7 to contain hard-material components, which consist of a compound of a metal with carbon, oxygen or nitrogen. Hard materials of this type increase the wear resistance of the valve seat 5 considerably.

The hard-material components may optionally be distributed homogeneously through the volume of the valve seat 5 or it is possible for the hard-material components to be distributed inhomogeneously through the volume of the valve seat 5, with the level of the hard-material components present increasing from the cylinder head 1 toward the surface of the valve seat 5. The latter alternative, i.e. what is known as a gradient layer, leads to an increase in the concentration of hard constituents toward the surface of the valve seat 5, thereby increasing the hardness properties and therefore the wear properties of the valve seat 5. At the same time, however, this also reduces the susceptibility to cracking in the joining zone, i.e. at the connecting surface between the valve seat 5 and the cylinder head 1.

The statements which have been made with regard to the advantages of the hard-material components also apply to the nickel and copper constituents, which on the one hand may be distributed homogeneously through the volume of the valve seat 5 or on the other hand may be distributed inhomogeneously through the volume of the valve seat 5, with the level of the nickel and copper constituents present increasing from the cylinder head 1 toward the surface of the valve seat 5.

As an alternative to the embodiment with an aluminum-iron alloy or a mixture of these metals, it is also possible for the filler material 7 used to be an alloy or mixture of aluminum and titanium. In this case, the filler material 7 may, for example, contain 30–40% by weight of aluminum and 60–70% by weight of titanium. Alternatively, it is also possible for the filler material 7 to contain 13–17% by weight of aluminum and 83–87% by weight of titanium.

In this case, the filler material 7 may contain at least one further constituent, specifically 0.5–5% by weight or 17–50% by weight of niobium, which is emanately suitable for reducing the tendency toward embrittlement. It is also possible for the filler material 7 to contain 0.5–5% by weight of chromium, vanadium, manganese, molybdenum and/or tantalum.

A third option relating to the formation of the filler material 7 may consist in using an alloy or mixture of an iron-carbon alloy and at least one further constituent for the filler material.

In this embodiment of the process, the filler material may contain as further constituent 0.5–4% by weight of nickel and/or 0.5–4% by weight of chromium and/or 0.5–4% by weight of manganese and/or 5–15% by weight of molybdenum and/or cobalt. The use of nickel and/or chromium allows the formation of carbides, which increase the hardness of the valve seat 5. Furthermore, in this context it is possible for the filler material 7 to contain 10–25% by weight of copper. Cobalt, copper and molybdenum improve the lubrication properties, and copper improves the thermal conductivity.

A fourth option for carrying out the process consists in the filler material 7 used being an alloy or mixture of a nickel-chromium alloy and at least one further constituent, in which case the nickel-chromium alloy may contain 10–30% by weight of chromium and 70–90% by weight of nickel.

For this embodiment, it is possible for 3–5% by weight of silicon to be used as a further alloying constituent. Further possible alloying constituents comprise 3–5% by weight of boron and 3–5% by weight of iron.

If appropriate, 10–40% by weight of molybdenum may be present in the filter material 7. Furthermore, it is possible for the filler material 7 to contain 5–10% by weight of copper and/or cobalt. Moreover, it is possible for the filler material 7 to contain 5–12% by weight of aluminum and 0.1–2% by weight of carbon and/or yttrium.

What is claimed is:

1. A process for producing a valve seat for a cylinder head of an internal combustion engine, comprising:

fusing a filler material to the cylinder head, by introduction of energy, at a location where a valve seat is to be formed, wherein the filler material comprises an alloy or mixture of 30–40% by weight of aluminum and 60–70% by weight of titanium.

2. The process as claimed in claim 1, wherein the filler material comprises at least one further constituent.

3. The process as claimed in claim 2, wherein the further constituent comprises 0.5–5% by weight of niobium.

4. The process as claimed in claim 2, wherein the further constituent comprises 17–50% by weight of niobium.

5. The process as claimed in claim 2, wherein the filler material comprises 0.5–5% by weight of chromium, vanadium, manganese, molybdenum or tantalum.

6. The process as claimed in claim 1, wherein fusing the filler material to the cylinder head comprises introducing energy using a laser beam.

7. The process as claimed in claim 1, wherein fusing the filler material to the cylinder head comprises introducing energy using an electron beam.

8. The process as claimed in claim 1, further comprising providing a magnetic field in the vicinity of the location of the valve seat, said magnetic field imparting contours to or intimately mixing the filler material or the melt formed from the filler material.

9. The process as claimed in claim 1, further comprising applying the filler material to the cylinder head, wherein applying the filler material to the cylinder head occurs at the same time as the introduction of energy for fusing the filler material.

10. The process as claimed in claim 1, further comprising applying the filler material to the cylinder head in powder form.

11. The process as claimed in claim 1, further comprising applying the filler material to the cylinder head using a nozzle.

12. The process as claimed in claim 1, further comprising applying the filler material to the cylinder head prior to fusing the filler material to the cylinder head.

13. The process as claimed in claim 12, wherein applying the filler material to the cylinder head comprises applying the filler material in powder form.

14. A process for producing a valve seat for a cylinder head of an internal combustion engine, comprising:

fusing a filler material to the cylinder head, by introduction of energy, at a location where a valve seat is to be formed, wherein the filler material comprises an alloy or mixture of 13–17% by weight of aluminum and 83–87% by weight of titanium.

15. The process as claimed in claim 14, wherein the filler material comprises at least one further constituent.

16. The process as claimed in claim 15, wherein the further constituent comprises 0.5–5% by weight of niobium.

17. The process as claimed in claim 15, wherein the further constituent comprises 17–50% by weight of niobium.

18. The process as claimed in claim 15, wherein the filler material comprises 0.5–5% by weight of chromium, vanadium, manganese, molybdenum or tantalum.

19. The process as claimed in claim 14, wherein fusing the filler material to the cylinder head comprises introducing energy using a laser beam.

20. The process as claimed in claim 14, wherein fusing the filler material to the cylinder head comprises introducing energy using an electron beam.

21. The process as claimed in claim 14, further comprising providing a magnetic field in the vicinity of the location of the valve seat, said magnetic field imparting contours to or intimately mixing the filler material or the melt formed from the filler material.

22. The process as claimed in claim 14, further comprising applying the filler material to the cylinder head, wherein applying the filler material to the cylinder head occurs at the same time as the introduction of energy for fusing the filler material.

23. The process as claimed in claim 14, further comprising applying the filler material to the cylinder head in powder form.

24. The process as claimed in claim 14, further comprising applying the filler material to the cylinder head using a nozzle.

25. The process as claimed in claim 14, further comprising applying the filler material to the cylinder head prior to fusing the filler material to the cylinder head.

26. The process as claimed in claim 25, wherein applying the filler material to the cylinder head comprises applying the filler material in powder form.

27. A valve seat arrangement for a cylinder head of an internal combustion engine, having a plurality of valve seats produced using the process as claimed in claim 14, and comprising said filler material, the valve seats in each case being widened by an annular region which comprises said filler material wherein the individual annular regions at least partially overlap.

* * * * *